US007394728B2

(12) United States Patent
Hyun

(10) Patent No.: US 7,394,728 B2
(45) Date of Patent: Jul. 1, 2008

(54) WRISTWATCH

(75) Inventor: Min Kyung Hyun, Seoul (KR)

(73) Assignee: Ecco Watch Co., Ltd., Seoul (KR)

( * ) Notice: Subject to any disclaimer, the term of this patent is extended or adjusted under 35 U.S.C. 154(b) by 29 days.

(21) Appl. No.: 11/253,518

(22) Filed: Oct. 19, 2005

(65) Prior Publication Data

US 2006/0291336 A1 Dec. 28, 2006

(30) Foreign Application Priority Data

Jun. 27, 2005 (KR) ..... 20-2005-0018578 U

(51) Int. Cl.
*G04C 19/00* (2006.01)
*G04C 23/02* (2006.01)
*G04B 37/00* (2006.01)
*A44C 5/00* (2006.01)

(52) U.S. Cl. ..... 368/88; 368/281; 368/309

(58) Field of Classification Search ..... 368/88, 368/276, 280–282, 294–300, 309
See application file for complete search history.

(56) References Cited

U.S. PATENT DOCUMENTS 4,692,033 A * 9/1987 Mock et al. ..... 368/280
4,727,524 A * 2/1988 Shoji et al. ..... 368/281
5,065,375 A * 11/1991 Gogniat ..... 368/281
6,382,829 B1 * 5/2002 Ursula ..... 368/285
6,762,976 B1 * 7/2004 Tamaru et al. ..... 368/88

* cited by examiner

*Primary Examiner*—Vit W Miska
(74) *Attorney, Agent, or Firm*—Ladas and Parry LLP

(57) ABSTRACT

A wristwatch is disclosed, which includes a watch body part in which a glass is engaged at an upper center portion of the same, a gemstone ring is engaged at an outer side of the same, an adjusting pin is engaged at one side of the same, and a back cover having a plurality of fixing holes is engaged at a lower side of the same; a body casing in which an engaging groove is formed at an upper center portion of the came so that the watch body part is engaged therein, a casing fixing hole is formed at both sides of a bottom of the engaging groove, an adjusting pin engaging part is formed at a front side of the same, and a chain engaging part is formed at both sides for thereby connecting a watch chain; a fixing screw which is engaged into a fixing hole of the back cover through the casing fixing hole for thereby fixing the watch body part at the engaging groove of the body casing; and a watch chain which is connected at the chain engaging parts of both sides of the body casing.

1 Claim, 3 Drawing Sheets

A-A'

A-A'

WRISTWATCH

TECHNICAL FIELD

The present invention relates to a wristwatch, and in particular to a wristwatch in which a watch body part of a wristwatch is engaged at an engaging groove of a body casing, so that a waterproof is obtained, and it feels soft when wearing a wristwatch for thereby implementing a wristwatch which is good for a human body.

BACKGROUND ART

Generally, a wristwatch includes a watch body part which indicates time, and a band shaped watch chain of which one end is connected with both ends of the watch body part, and the other end is connected with an engaging member such as a connection rung, etc, so that a user can wear a wristwatch adjusting the length of a watch chain based on a user's wrist size. With the above construction, a user can check time, so that a wristwatch has been recognized as an important item in life. The importance of a wristwatch has increased to modern people who are very busy.

However, the conventional wristwatch has the same structures and operation methods. The outer looks of the wristwatches are more emphasized by decorating certain expensive gemstones such as diamond, etc. as compared to their functional or practical views. New generations need various demands based on their characteristics and feelings.

Therefore, as the demand of new generation who wants to express various personalities increase, and a wristwatch tends to be a fashion item for showing a style and personality it is urgently needed to fabricate a wristwatch having a new feeling escaping from a conventional typical design.

So as to overcome the above problems, a large hole is formed at a center of a body casing of which both ends are connected with a watch chain, and a watch body part is inserted through an upper side of the hole and is fixed using an adhesive. A back cover is assembled for thereby finishing a fabrication of a wristwatch.

In the conventional wristwatch, since a back cover engaged to a lower side of a watch body part is exposed to the outside, so that there is a water sealing problem. In addition, since a metallic back cover is directly contacted with a skin, it is not good for human body.

DISCLOSURE OF THE INVENTION

Accordingly, it is an object of the present invention to overcome the problems encountered in the conventional art.

It is another object of the present invention to provide a wristwatch in which a wristwatch is configured so that a watch body part is fixedly engaged at a body casing, whereby young generation people like a wristwatch of the present invention.

It is further object of the present invention to provide a wristwatch in which a watch body part of a wristwatch is engaged at an engaging groove of a body casing for thereby fixing at a back surface, so that a desired sealing effect is achieved, and it feels soft when wearing a wristwatch of the present invention since a portion contacting with a wrist is formed of a ceramic material.

It is still further object of the present invention to provide a wristwatch in which a watch body part of a wristwatch is fixedly engaged at an engaging groove, so that a back cover portion of a watch body part is not seen from the outside, whereby the value of a wristwatch is enhanced, and a good outer look can be obtained.

To achieve the above objects, there is provided a wristwatch comprising a watch body part in which a glass is engaged at an upper center portion of the same, a gemstone ring is engaged at an outer side of the same, an adjusting pin is engaged at one side of the same, and a back cover having a plurality of fixing holes is engaged at a lower side of the same; a body casing in which an engaging groove is formed at an upper center portion of the came so that the watch body part is engaged therein, a casing fixing hole is formed at both sides of a bottom of the engaging groove, an adjusting pin engaging part is formed at a front side of the same, and a chain engaging part is formed at both sides for thereby connecting a watch chain; a fixing screw which is engaged into a fixing hole of the back cover through the casing fixing hole for thereby fixing the watch body part at the engaging groove of the body casing; and a watch chain which is connected at the chain engaging parts of both sides of the body casing.

The body casing is formed of a ceramic material.

Fixing holes are formed at a bottom of the engaging groove of the body casing.

MODES FOR CARRYING OUT THE INVENTION

Figure 1:
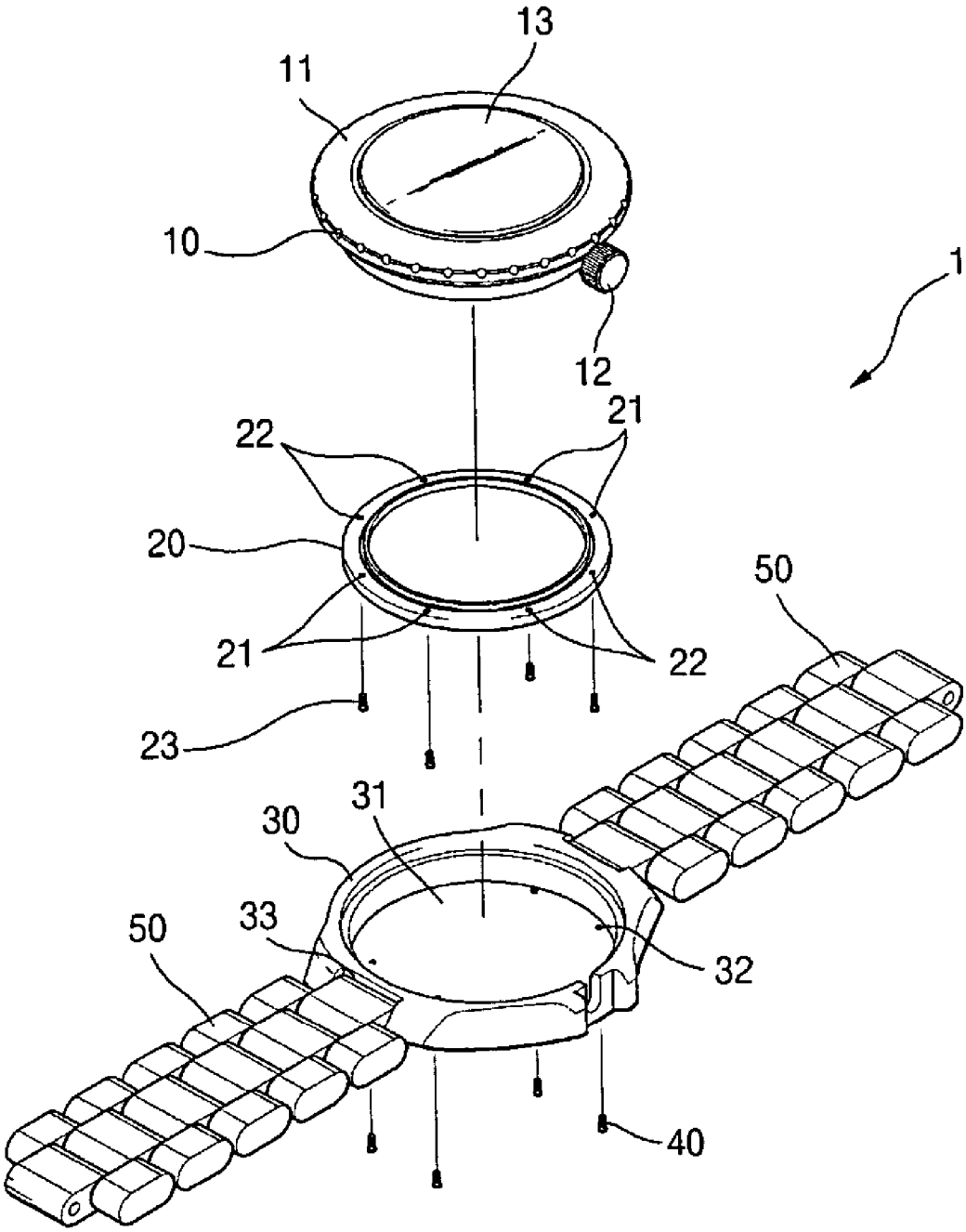
FIG. 1 is a disassembled perspective view illustrating a wristwatch according to the present invention.
Figure 2:
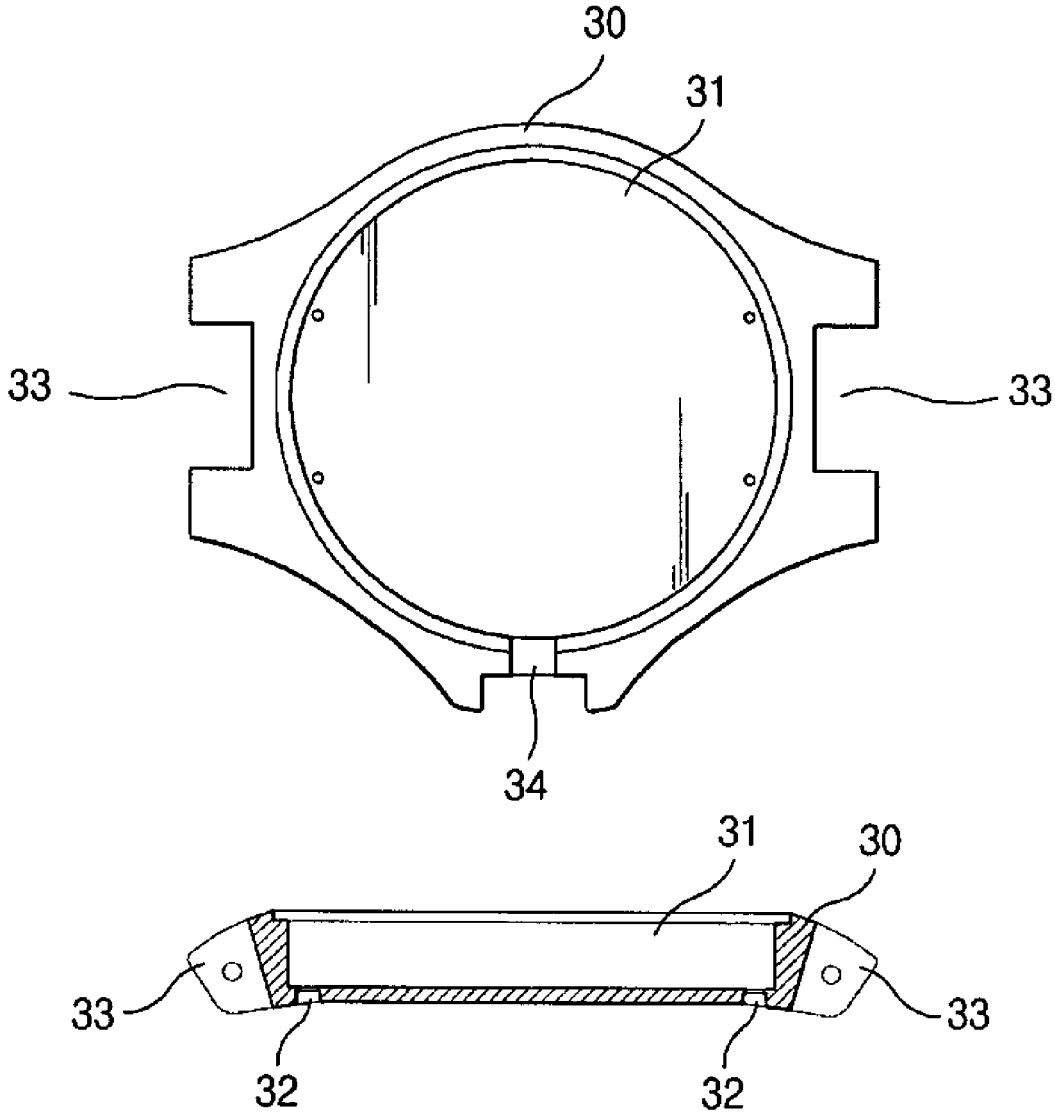
FIG. 2 is a plane and cross sectional view illustrating a body casing according to the present invention.
Figure 3:
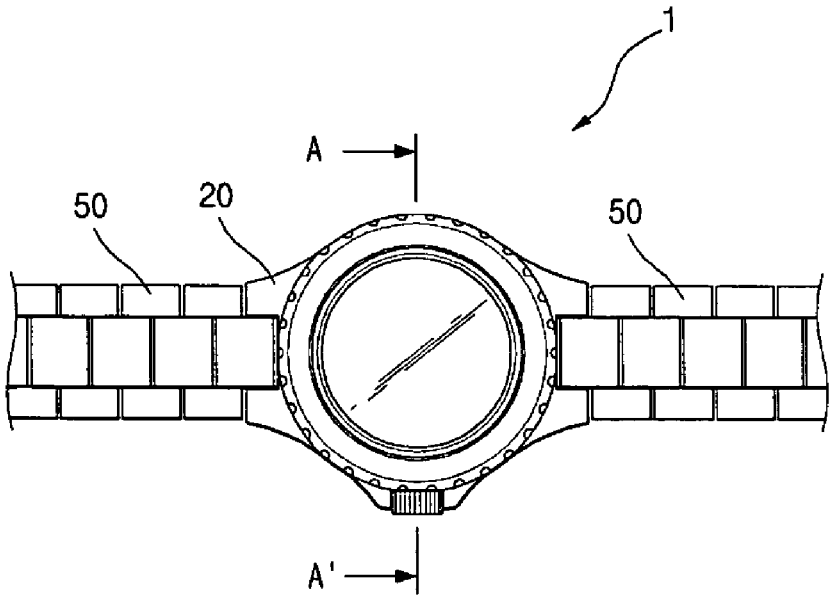
FIG. 3 is a view illustrating an engaged state of a wristwatch according to the present invention.
Figure 4:
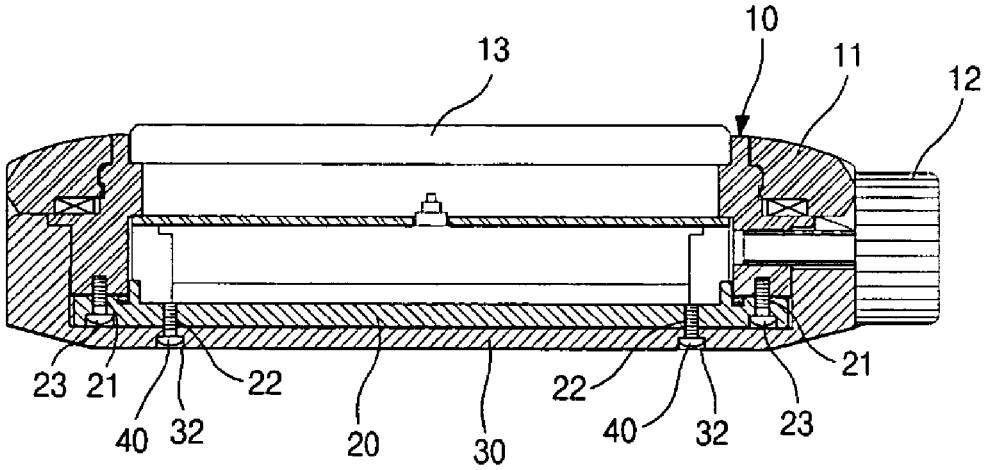
FIG. 4 is a cross sectional taken along line A-A' of FIG. 3.

FIG. 1 is a disassembled perspective view illustrating a wristwatch according to the present invention, FIG. 2 is a plane and cross sectional view illustrating a body casing according to the present invention, FIG. 3 is a view illustrating an engaged state of a wristwatch according to the present invention, and FIG. 4 is a cross sectional taken along line A-A' of FIG. 3.

The preferred embodiments of the present invention will be described with reference to FIGS. 1 through 4.

A wristwatch 1 according to the present invention includes a watch body part 10, a body casing 30, and a watch chain 50.

In the watch body part 10, a glass 13 is engaged at an upper center portion of the same, and a gemstone ring 11 is engaged at an outer side of the same, and an adjusting pin 12 is engaged at one side of the same. A back cover 20 having a plurality of fixing holes 21 and 22 is engaged by a fixing bolt 23.

Eight fixing holes are formed at the back cover 20. Among eight holes, four fixing holes 21 are used for engaging the watch body part 10 and the back cover 20 using the fixing bolts 40, and the remaining four fixing holes 22 are used for fixing the watch body part 10 to the body casing 30.

The body casing 30 includes an engaging groove 31 for engaging the watch body part 10. A casing fixing hole 32 is formed at both sides of a bottom of the engaging groove 31. An adjusting pin engaging part 34 is formed at a front side of the same. A chain engaging part 33 is formed at both sides of the same for connecting the watch chain 50.

The watch body part 10 is fixed at the engaging groove 31 of the body casing 30 in such a manner that a fixing screw 40 is engaged into the fixing hole 22 of the back cover 20 through the casing fixing hole 32 from the lower side of the body casing 30. In addition, the watch chain 50 is engaged at the chain engaging part 33 of both sides of the body casing 30 using a certain connection member such as a connection pin.

Here, the body casing 30 is preferably formed of a ceramic material. Four casing fixing holes 32 are formed at the bottom of the engaging groove 31 of the body casing 30.

In the case of the wristwatch 1 according to the present invention, the glass 13 is sealingly engaged at the upper center portion of the watch body 10. The gemstone ring 11 is engaged at an outer side of the watch body part 10, and the adjusting pin 12 is engaged at one side of the watch body part 10. The back cover 20 having a plurality of the fixing holes 21 and 22 is engaged at the lower side of the watch body part 10 using the fixing bolts 23 inserted through the fixing holes 21. Here, the gemstone ring 11 may be provided in various kinds of gemstones.

Next, the watch body part 10 is engaged at the engaging groove 31 of the upper center portion of the body casing 30 so that the adjusting pin 12 is positioned at the adjusting pin engaging part 34. The fixing screws 40 are engaged into the fixing holes 22 formed at the back cover 20 of the watch body part 10 through the four casing fixing holes 32 formed at both sides of the bottom of the engaging groove 31, so that the watch body part 10 is fixed at the engaging groove 31 of the body casing 30. The watch chain 50 is connected at the chain engaging part 33 formed at both sides of the body casing 30 for thereby finishing an assembling procedure of the wristwatch 1. Here, the engaging groove 31 of the body casing 30 may be formed in a circular shape or a rectangular shape based on the shape of the watch body part 10.

The body casing 30 is fixed at the back surface using a fixing belt 40 by providing various types of watch body pats 10. Here, the construction of the body casing 30 may change based on the function and type of the watch.

In the wristwatch 1 according to the present invention, the watch body part 10 is engaged at the engaging groove 31 of the body casing 30, and the body casing 30 is engaged with the watch body part 10 from the lower side using the fixing bolts 40. Therefore, the back cover 20 of the watch body part 10 is not seen from the outside, so that the value of the product is increased, and a good outer look can be achieved.

In addition, the wristwatch 1 according to the present invention has a waterproof effect when wearing the same. Since the ceramic body casing 30 contacts with the wrist, it feels soft and is good to human body. The ceramic body casing 30 can be used so as to fabricate a new concept wristwatch having an accessory function, so that new generation young people can like the wristwatch according to the present invention.

As described above, the wristwatch according to the present invention is fabricated by fixedly engaging the watch body part at the body casing, so that a new concept wristwatch having an accessory function can be provided to new generation young people. In addition, an excellent waterproof function is provided. Since a ceramic material is directly contacted with a user's wrist, it feels soft and is good for a human body. Since the back cover of the watch body part is not seen from the outside, the price of the product can be enhanced, and a good outer look can be achieved.

As the present invention may be embodied in several forms without departing from the spirit or essential characteristics thereof, it should also be understood that the above-described examples are not limited by any of the details of the foregoing description, unless otherwise specified, but rather should be construed broadly within its spirit and scope as defined in the appended claims, and therefore all changes and modifications that fall within the meets and bounds of the claims, or equivalences of such meets and bounds are therefore intended to be embraced by the appended claims.

What is claimed is:

1. A wristwatch, comprising:

a watch body part having an adjusting pin at one side, a glass engaged at an upper center portion, and a gemstone ring engaged at an outer side;

a back cover having fixing holes;

first means in the fixing holes and engaging the watch body part for fixing the back cover thereto;

a body casing having an engaging groove at an upper center portion for receiving at least the back cover and, at a perimeter, the adjusting pin, casing fixing holes at a bottom of the engaging groove, and engaging parts at opposite sides for connecting a watch chain; and second means in the casing fixing holes and engaging at least one of the watch body part and back cover for fixing the body casing thereto.

* * * * *